US005476439A

United States Patent [19]

Robinson

[11] Patent Number: 5,476,439

[45] Date of Patent: Dec. 19, 1995

[54] REMEDIAL HAND WEAR ARTICLE

[76] Inventor: Margaret E. Robinson, 4996 Concord Glen Dr., Cincinnati, Ohio 45244

[21] Appl. No.: 259,175

[22] Filed: Jun. 13, 1994

[51] Int. Cl.[6] ..... A61H 1/02

[52] U.S. Cl. ..... 601/40; 602/22; 128/879

[58] Field of Search ..... 601/40; 602/21, 602/22; 482/44, 47, 48, 49, 124; 2/160, 161.1, 161.2, 161.5, 161.6, 161.7; 128/878, 879, 880; 273/188, 189 R, 189 A, 26c; 473/61, 62

[56] References Cited

U.S. PATENT DOCUMENTS

| | | | |
|---|---|---|---|
| 1,469,315 | 10/1923 | Hansard | 602/21 |
| 2,025,357 | 12/1935 | Pagan | 2/161.6 |
| 2,863,449 | 12/1958 | Spencer | 602/21 |
| 3,299,887 | 1/1967 | Czap | 602/21 |
| 4,173,218 | 11/1979 | Cronin . | |
| 4,366,812 | 1/1983 | Nuzzo . | |
| 4,445,507 | 5/1984 | Eisenberg . | |
| 4,675,914 | 6/1987 | Mitchell | 2/161.2 |
| 4,706,658 | 11/1987 | Cronin | 602/21 |
| 4,765,320 | 8/1988 | Lindemann et al. | 602/22 |
| 4,781,178 | 11/1988 | Gordon . | |
| 4,830,360 | 5/1989 | Carr, Jr. | 601/40 |
| 5,058,576 | 10/1991 | Grim et al. . | |

FOREIGN PATENT DOCUMENTS

| | | | |
|---|---|---|---|
| 296148 | 1/1917 | Germany | 602/21 |

*Primary Examiner*—Richard J. Apley
*Assistant Examiner*—Jeanne M. Clark
*Attorney, Agent, or Firm*—Charles R. Wilson

[57] ABSTRACT

A remedial hand wear article is for use by individuals who have suffered nerve damage which diminishes use of the hand. The article comprises (a) a glove for comfortably fitting onto a hand of an individual, (b) an enclosure permanently attached on the glove's top side and superimposed over at least one finger of the glove, and (c) a restraining member positioned within the enclosure so as to be operably associated with a finger of the individual to hold that finger in a desired position. The hand wear article is designed to remedy problems caused by different nerve damage in that one to five enclosure elongated sections are permanently attached over glove fingers depending on which finger(s) of the individual is affected by the damaged nerve. The glove portion of the hand wear article provides comfort to the user while also serving to lessen the noticeability of any hand or finger grotesqueness. The restraining members are either spring-like or rigid in nature depending on the particular nerve damage and care which is needed.

13 Claims, 5 Drawing Sheets

REMEDIAL HAND WEAR ARTICLE

This invention relates to a remedial hand wear article. More particularly, the invention relates to a remedial hand wear article for use by individuals who have suffered nerve damage in an arm, wrist or hand.

BACKGROUND OF INVENTION

Individuals occasionally suffer injuries to the arm, wrist or hand which damage one or more nerves. A nerve can be crushed in which individual fibers within the nerve may be severed while a nerve trunk remains intact. The severed fibers degenerate and lead to loss of power in the muscles and loss of sensation in the skin area supplied by the fibers. New fibers can regenerate and eventually the individual may regain all normal muscle and sensation functions. A fully severed nerve requires surgical repair. The recovery period is longer. Most importantly, during the healing process it is necessary that the affected areas be protected and that constant hand therapy be administered. The therapy is needed to keep muscles, tendons and joints affected by the nerve damage healthy and free from contractures.

Depending on which nerve leading to the hand is damaged and the extent of the damage, the individual will experience diminished use of the hand and one or more fingers. The diminished use can manifest itself by weakened wrist and finger movements such that the hand is incapable of significant use. Diminished use of one or more fingers will affect the individual's ability to grasp objects or perform other finger manipulations which are taken for granted. Besides the diminished physical use of the hand or fingers, the nerve damage can result in the hand or fingers drooping and/or hyperextending in a noticeably unnatural manner. This unnatural appearance alone can be a concern to the individual.

Certain diseases also inflict the nerves that control the hand. Here also, surgery and/or hand therapy can help the individual regain partial or full use of the hand or fingers.

Many medical devices are available to alleviate or correct problems with the hand or fingers. Some hand wear articles such as described in U.S. Pat. Nos. 4,366,812 and 5,058,576 are intended for short term use primarily to immobilize a bone while it mends. Other hand wear articles are for use by individuals who suffer from rheumatoid arthritis. These articles are primarily intended to rigidly hold fingers in a natural position against the deforming forces of arthritis. U.S. Pat. Nos. 4,173,218 and 4,781,178 describe two such articles. There also have been developed hand wear articles which are intended to restrict thumb movement while it is healing from a prior ligament injury. An example of such an article is found described in U.S. Pat. No. 4,445,507.

There is presently a need for a remedial hand wear article which is able to alleviate the discomfort and diminished use of a hand or fingers caused by some form of nerve damage. The article must be capable of its intended use. It must be comfortable to wear and have a natural appearance so as to encourage its use. It also must be economical to manufacture. In accord with the need, there has been developed a remedial hand wear article which meets the recognized needs of many individuals who have suffered nerve damage.

SUMMARY OF THE INVENTION

A remedial hand wear article comprises (a) a glove for comfortably fitting onto a hand of an individual, (b) an enclosure superimposed on a top side of the glove and permanently attached thereto, and (c) at least one restraining member positioned within the enclosure and operably associated with a finger of the individual to hold that finger in a desired position. The hand wear article is designed to remedy problems caused by different nerve damage in that the enclosure extends over one to five fingers of the glove depending on which finger(s) of the individual is affected by the damaged nerve. The glove portion of the hand wear article provides comfort to the user while also serving to lessen the noticeability of any hand or finger grotesqueness.

DETAILED DESCRIPTION OF THE INVENTION

The remedial hand wear article of the invention is described in the following paragraphs and with reference to the drawings. The article is versatile in that it can be configured to remedy different nerve damage effects. A single finger ranging up to all the fingers can be affected by a particular injury and can be remedied by the remedial hand wear article. As used throughout, the commonly called thumb, index finger, middle finger, ring finger and little finger are referred to as the first, second, third, fourth and fifth fingers, respectively.

An individual's hand and finger muscles are controlled by a set of peripheral nerves known as the radial nerve, median nerve and ulnar nerve. The radial nerve leads to extensor muscles of the arm and forearm and controls all five fingers. The median nerve controls the first, second and third fingers. The ulnar nerve controls the fourth and fifth fingers. Movements of the wrist and fingers are affected by damage to one or more of the radial, median and ulnar nerves. The damage is manifested by wrist droop as well as diminished abduction, adduction and extension of possibly all the fingers. One or more of the effects result depending on the nerve damaged. In accord with the invention, the remedial hand wear article is configured based on the individual's particular nerve damage and consequent needs. The hand wear articles which are discussed below are the most commonly needed and for this reason are described in detail.

Figure 1:
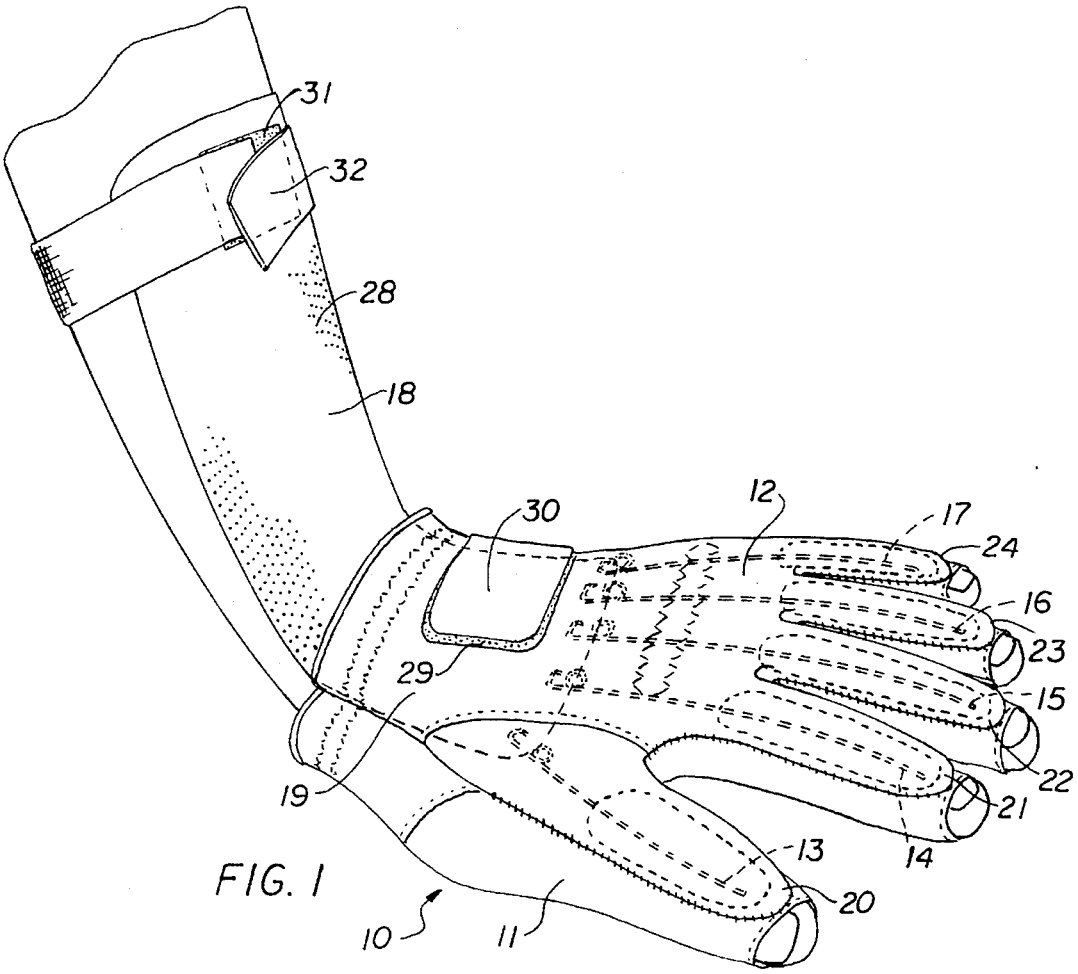
FIG. 1 is a perspective view of a remedial hand wear article of the invention intended for use by an individual who has radial nerve damage.
Figure 2:
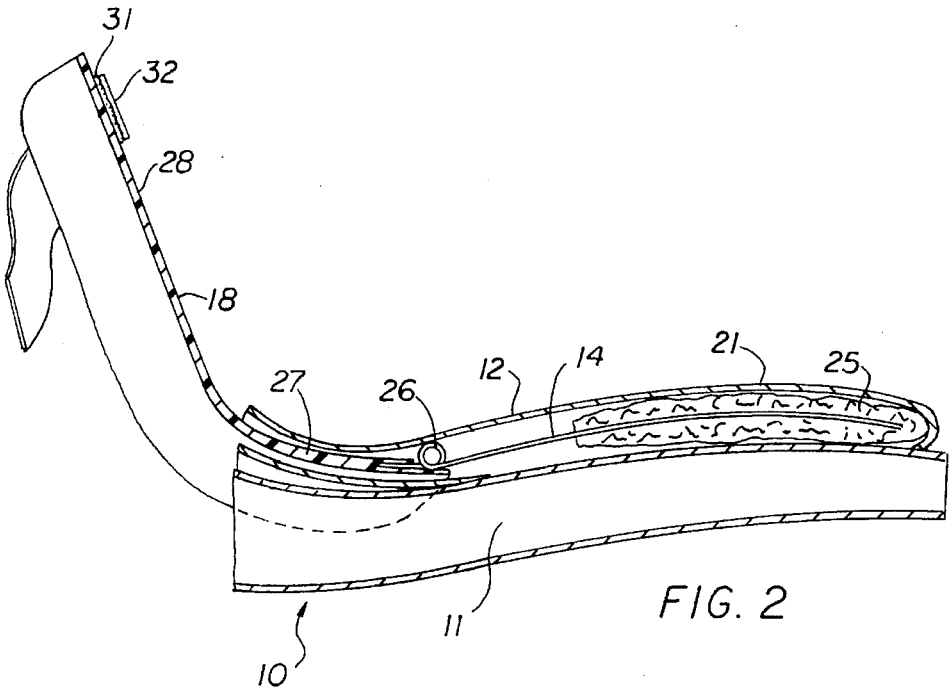
FIG. 2 is an elevational view in section of the remedial hand wear article of FIG. 1.

With reference to FIGS. 1 and 2, there is illustrated a remedial hand wear article 10 of the invention which is particularly useful to individuals who have experienced radial nerve damage. The individual has greatly diminished control of the wrist and the fingers. The wrist involuntary droops. All five fingers also involuntary droop. The individual is not able to pull back or straightened out the wrist or fingers and hold them in a natural state. Radial nerve damage causes a diminished ability of the individual to grasp objects with the fingers and thumb. There is also a loss of sensation in the back of the hand and forearm.

The remedial hand wear article 10 comprises a glove 11, an enclosure 12 superimposed on the top side of the glove, and restraining members in the form of spring wires 13–17 within the enclosure and in operable association with the fingers of the individual. A substantially rigid member 18 shaped to fit within the enclosure is also provided to hold the user's wrist in a generally natural manner. A discussion of the individual components of the remedial hand wear article 10 and their purposes follow.

The glove 11 of the remedial hand wear article 10 has a typical glove construction such as found with winter gloves for cold weather use or safety gloves for the workplace. The glove 11 is constructed to fit comfortably onto the user's hand. It has a back hand side, palm side, and five fingers extending therefrom. The parts of the glove are sewn or otherwise held together to form a one-piece item which encompasses an individual's hand when worn. As shown, the fingertips of the glove 11 are removed, i.e. each is open at its outer extremity. The individual wearing the remedial hand wear article 10 still has functional sensation in the tips of the fingers. The open fingertips in the glove allow the individual to experience touch sensations. Full fingers in the glove can be used, but are less preferred because of the touch sensations they necessarily lessen in the individual.

The remedial hand wear article 10 has the enclosure 12 superimposed over the top side of the glove 11 and permanently attached thereto. As shown, the enclosure 12 is open bottom and is sewn along its edges to the top side of the glove 11. Other means of attaching the enclosure such as heat sealing and adhesive are also possible. The enclosure 12 is made up of a planar section 19 which overlies the back hand side of the glove and five elongated sections 20–24 which overlie the five fingers of the glove. In effect, the enclosure 12 itself has a glove shape.

Within each of the elongated sections 20–24 of the enclosure 12 are positioned the restraining members. The restraining members are spring wires 13–17, each of which extends substantially the full length of its respective enclosure elongated section and into the planar section 19. The spring wires illustrated all include a looped end permanently attached to the rigid member 18. As best seen in FIG. 2, the looped end 26 of the spring wire 14 is embedded in the rigid member 18. Mechanical and adhesive attachment means can as well be used for this purpose. Thus, the first finger or thumb of the glove has an overlying first elongated section 20 with a spring wire 13 contained within. The second, third, fourth and fifth fingers of the glove have superimposed enclosure elongated sections 21, 22, 23 and 24, respectively. The spring wires 14, 15, 16 and 17 are contained within the elongated sections 21, 22, 23 and 24, respectively.

A padding material 25 encompasses each of the spring wires 13–17 for comfort and protection. Such padding can be a synthetic polymeric foam, fibrous material, or other commercially available force absorbing material. It is secured to the wires in a conventional manner.

The L-shaped substantially rigid member 18 which generally coincides with the shape of a back side of the hand, the wrist and the forearm when held in a natural state is positioned within the enclosure 12 and is dimensioned to substantially laterally fill the volumetric area of the enclosure's planar section to minimize movement. The rigid member 18 provides an anchor for the five spring wires to hold them in place. It also serves to immobilize the wrist and hand in a position which is natural. As shown, a first leg 27 of the L-shaped rigid member partially overlies the back side of the hand. A second leg 28 of the L-shaped rigid member extends out of the enclosure's planar section and beyond the glove's perimeter.

An adjustable retention member in the form of mating hook and loop fastener straps 29 and 30, commonly known as Velcro, is provided on the outside of the enclosure 12 near the wrist end of the glove 11 to force the underlying rigid member 18 into close contact with the user's hand. A second set of mating hook and loop fastener straps 31 and 32 is positioned at a proximal end of the rigid member 18. The strap 32 has a length sufficient to wrap around the user's forearm and attach to the mating strap 31 to ensure that the rigid member remains in contact with the user's forearm. Other retention members such as tie cords, belt and buckle and the like can be used.

In use, the individual slips the glove 11 of the remedial hand wear article 10 onto a hand. The fastener straps 30 and 32 are unattached. Once the hand is fully inserted into the glove, the straps 30 and 32 are pulled tight and caused to overlap on underlying mating straps 29 and 31 and are secured thereto. The user's hand is forced to assume a naturally held extended state with the five fingers also in a naturally extended state. The nature of the radial nerve damage is such that the individual is able to force a flexion of the fingers inwardly towards the hand's palm area and hold that position. When desired, the individual relaxes the hand/finger muscles causing the bent spring wires to extend back to a relaxed generally straightened state and consequently force operably associated fingers of the individual to follow.

It should be apparent the remedial hand wear article 10 allows the user to hold the hand and fingers in a virtually natural and inconspicuous manner. More importantly, the spring wire restraining members allow the individual to grasp objects and basically use the fingers in a greatly enhanced, almost full manner.

Figure 3:
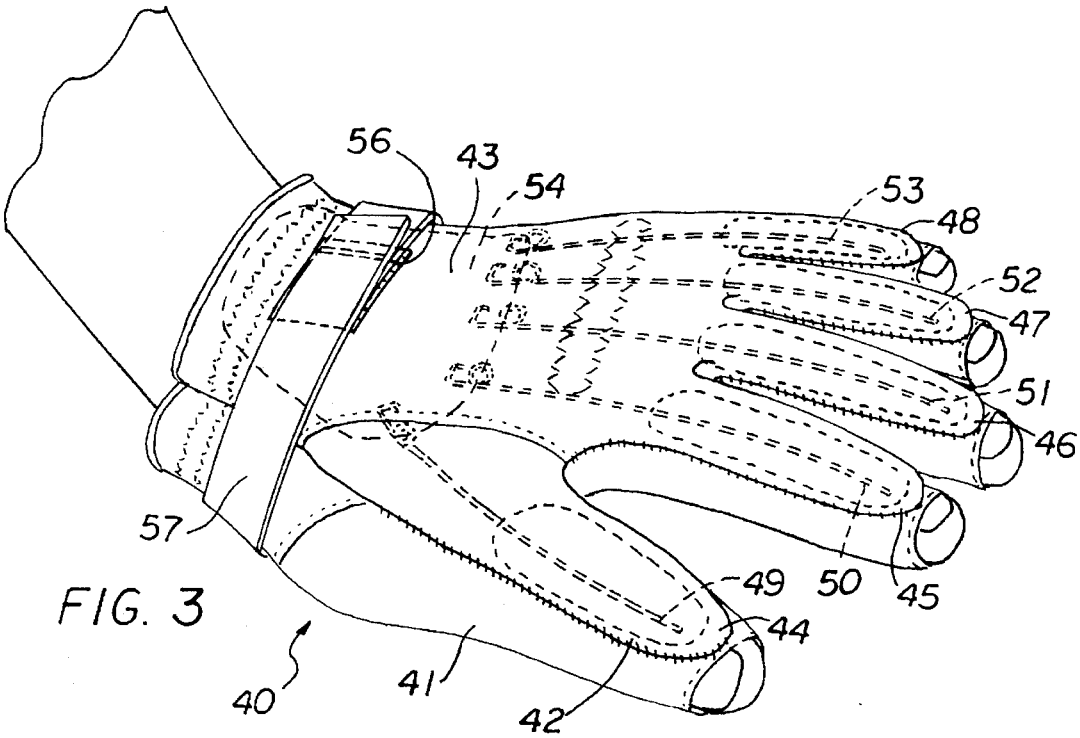
FIG. 3 is a perspective view of another remedial hand wear article of the invention intended for use by an individual who is experiencing posterior interosseous palsy.
Figure 4:
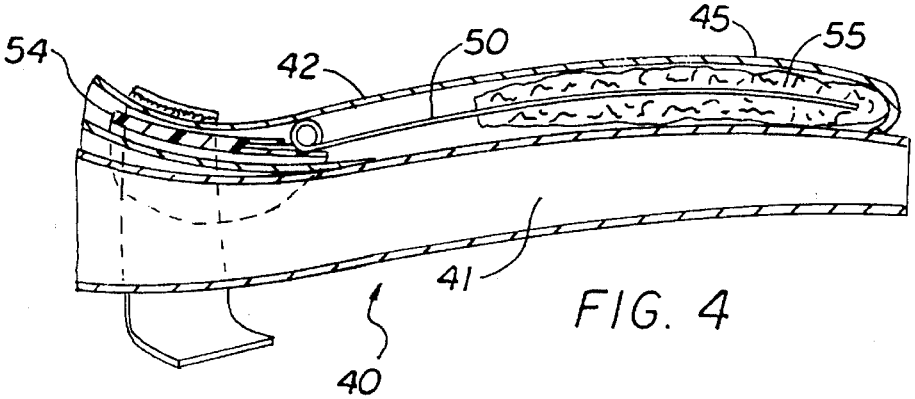
FIG. 4 is an elevational view in section of the remedial hand wear article of FIG. 3.
Figure 5:
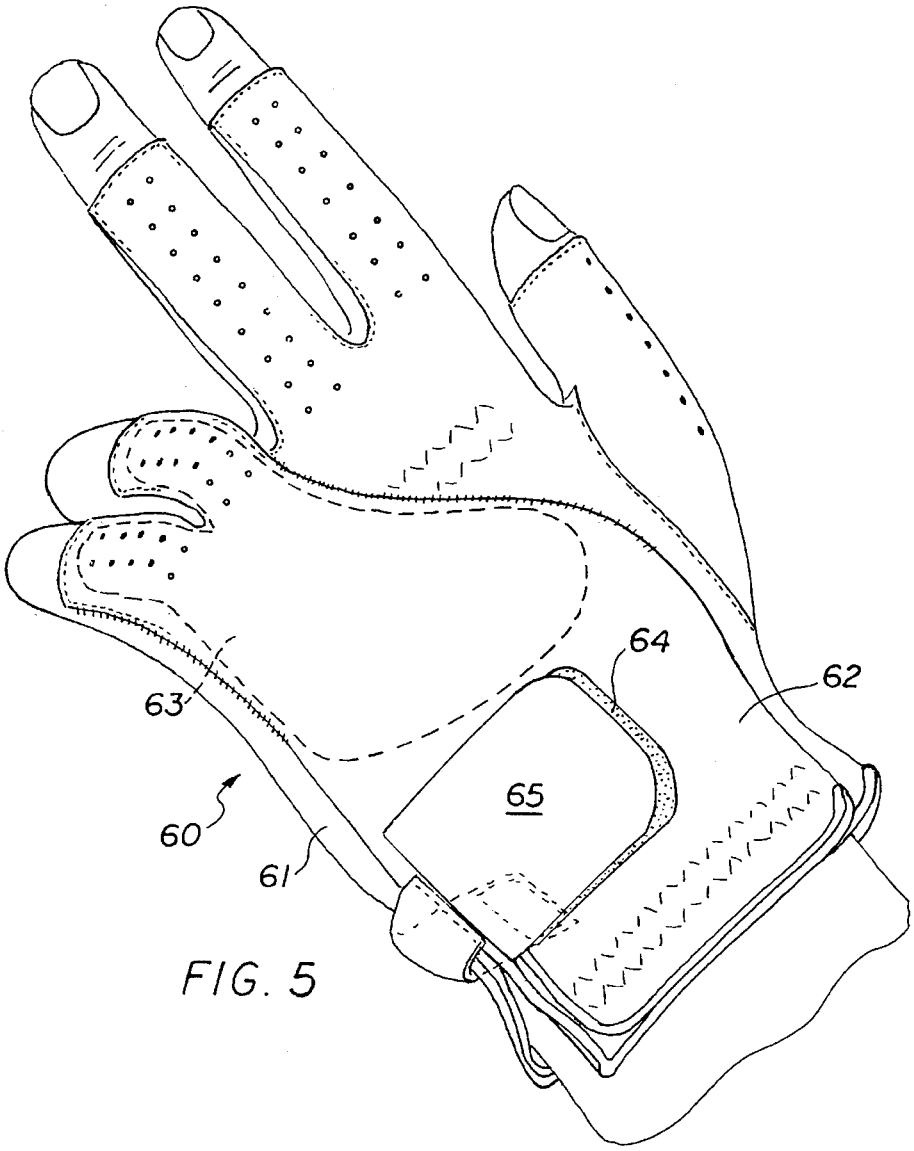
FIG. 5 is a perspective view of a remedial hand wear article of the invention intended for use by an individual with ulnar nerve damage.
Figure 6:
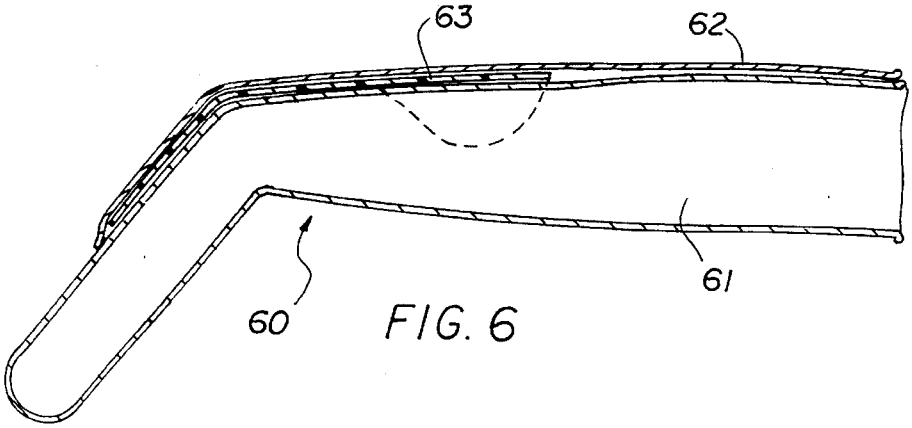
FIG. 6 is an elevational view in section of the remedial hand wear article of FIG. 5.

The remedial hand wear article 40 of FIGS. 3 and 4 is for use by individuals with posterior interosseous. They show many of the same diminished hand and finger functions described above with respect to the individual who has radial nerve damage. However, the individual has substantially full use of the wrist and does not require the L-shaped rigid member of the remedial hand wear article 10. The remedial hand wear article 40 comprises a glove 41 and an enclosure 42. The glove 41 is the same as described above with reference to FIGS. 1 and 2, except a rigid member in the enclosure is configured differently as described below. The enclosure 42 is superimposed over the back hand side of the glove and the top side of five fingers of the glove and is permanently attached. The enclosure 42 has a planar section 43 which overlies the back hand side of the glove and five elongated sections 44–48 which overlie the top sides of the first through fifth fingers of the glove.

Spring wires 49, 50, 51, 52 and 53 are positioned in the elongated sections 44, 45, 46, 47 and 48, respectively of the enclosure 42. Each of the spring wires extends substantially the length of its enclosure elongated section and into the planar section 43. A substantially flat rigid member 54 is positioned in the planar section of the enclosure 42. It is contoured to overlie the back side of the user's hand. Each of the spring wires is permanently attached at one end to an edge of the rigid member 54. Padding 55 of the nature described above encompasses each spring wire.

A retention member which is adjustable is used to hold the glove and its associated restraining members in place. As shown, a set of hook and loop fastener straps 56 and 57 are attached near the wrist area of the glove 41. The strap 56 is sewn onto the glove and the strap 57 has a length which allows it to wrap around the wrist of the user and mate with the strap 56 to semi-permanently lock together.

The remedial hand wear article 40 is used in much the same way as the hand wear article 10 described above. The glove 41 of the article 40 is slipped onto the hand of the user. The fastener strap 57 is wrapped around the wrist until snug and then forced into contact with the underlying fastener strap 56. The spring wires 49–53 are extended substantially straight and as such hold the operably associated five fingers of the user in a substantially straight manner. The user is able to bend the five fingers towards the palm of the hand and use the fingers for normal holding and grasping purposes. Relaxing the finger muscles causes the bent spring wires to resume their relaxed substantially straight extended state and carry along the associated fingers of the user.

FIGS. 5–9 illustrate other embodiments of the invention intended to be used with individuals who have experienced certain nerve damage which diminishes the use of all or specific fingers. With respect to FIGS. 5 and 6, there is shown a remedial hand wear article 60 of the invention for use by an individual who has suffered ulnar nerve damage. The ulnar nerve controls the fourth and fifth fingers. These two fingers tend to hyperextend at the proximal joints when the ulnar nerve is damaged. This causes a clawing deformity at the distal joints. If not controlled, the fingers will be permanently distorted in that position.

The remedial hand wear article 60 comprises a glove 61, an enclosure 62 superimposed over the fourth and fifth fingers of the glove and over a portion of the back hand side of the glove, and a restraining member in the form of a substantially rigid member 63 positioned in the enclosure 62. The glove 61 is conventional and similar to those described above. Its fingertips have been optionally removed from the first, second and third fingers so that the individual will be able to experience touch sensation. The fingertips of the fourth and fifth glove fingers have been retained. Sensations are lost in the individual's fourth and fifth fingers. Accordingly, it is highly preferred that the glove's fourth and fifth fingers remain intact because of the protection they afford against the individual inadvertently damaging an exposed finger. This can easily occur by touching a hot or excessively cold item and not immediately realizing the damage being done because of the lack of touch sensation.

The enclosure 62 superimposed on the glove 61 and permanently attached thereto is to accommodate the substantially rigid member 63. The enclosure has two elongated sections that overlie the fourth and fifth fingers of the glove. It also has a planar section that overlies generally an outside half of the glove's back hand side. The elongated sections and planar section are in communication and together represent a single enclosure. The substantially rigid member 63 which is positioned within the enclosure is shaped to follow the contour of the user's back hand and the fourth and finger top sides up to each finger's second knuckle when slightly bent. The rigid member in the remedial hand wear article 60 ensures that the operably associated fingers of the user are not able to hyperextend at the first knuckle of the fourth and fifth fingers while allowing full extension at the second and third knuckles. This ensures against a permanent claw deformity to the two fingers.

A retention member is used to hold the glove 61 of the article 60 in position during use. It has a hook and loop fastener strap 64 positioned on the glove's back side near the wrist end. It also has a mating hook and loop fastener strap 65 attached at one end to the glove and having a length to wrap around the wrist of the user and mate with the fastener strap 64.

Figure 7:
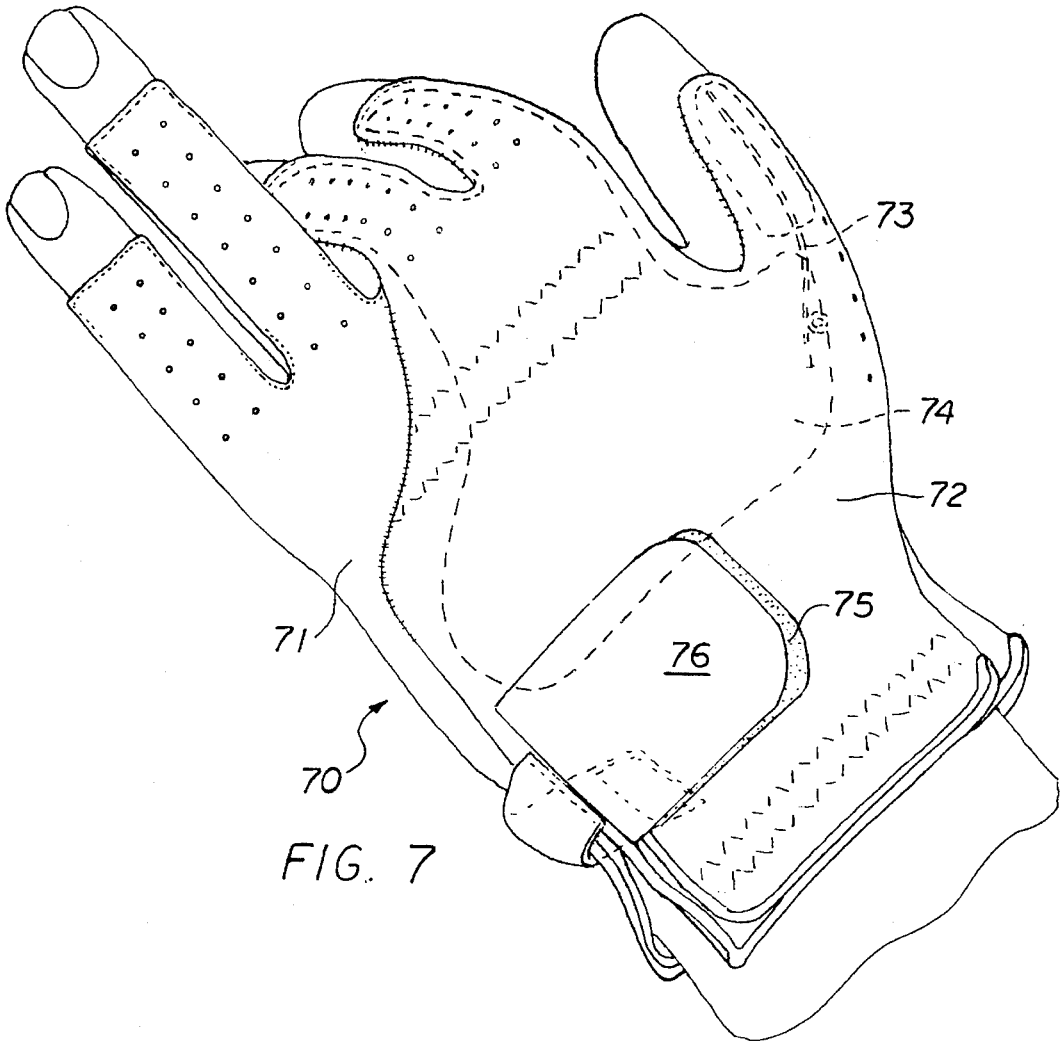
FIG. 7 is a perspective view of a remedial hand wear article of the invention intended for use by an individual who has suffered median nerve damage.

FIG. 7 illustrates a remedial hand wear article 70 of the invention intended for use by an individual who has suffered median nerve damage. The individual has weak or non-existent first finger abduction and opposition. This results in the inability to bring the first finger away from the palm area of the hand and to reach the first finger over to the fifth finger. Mild hyperextension of the first knuckle in the second and third fingers may result as well. Touch sensation in the three aforementioned fingers is diminished.

The remedial hand wear article 70 includes a glove 71 and an enclosure 72 superimposed over the back hand side of the glove and over the first, second and third fingers thereof. A spring wire 73 is positioned in that part of the enclosure overlying the first finger and a substantially rigid member 74 is positioned in that part of the enclosure overlying the second and third fingers.

The glove 71 is similar in construction to that described above, though those fingertips which are susceptible to damage because of the diminished touch sensation are closed. The enclosure 72 is shaped to cover substantially the full back side of the glove and the first, second and third fingers of the glove. The substantially rigid member 74 is dimensioned and shaped to follow the contour of the user's back hand, and second and third finger top sides when held in a generally straight manner. The spring wire 73 is permanently attached at one end to an edge of the rigid member 74. It extends the length of the enclosure's elongated section which overlies the first finger of the glove. The article 70 also has a retention member comprised of mating hook and loop fastener straps 75 and 76 at the glove's wrist end.

It should be evident the spring wire 73 in the remedial hand wear article 70 forces the first finger into an abducted state. This allows flexion of the first finger for functional pinch. The substantially rigid member 74 when positioned in the enclosure 72 of the article 70 prevents hyperextension at the first knuckles, therefore protecting against any clawing deformities to the distal knuckles of the second and third fingers.

Figure 8:
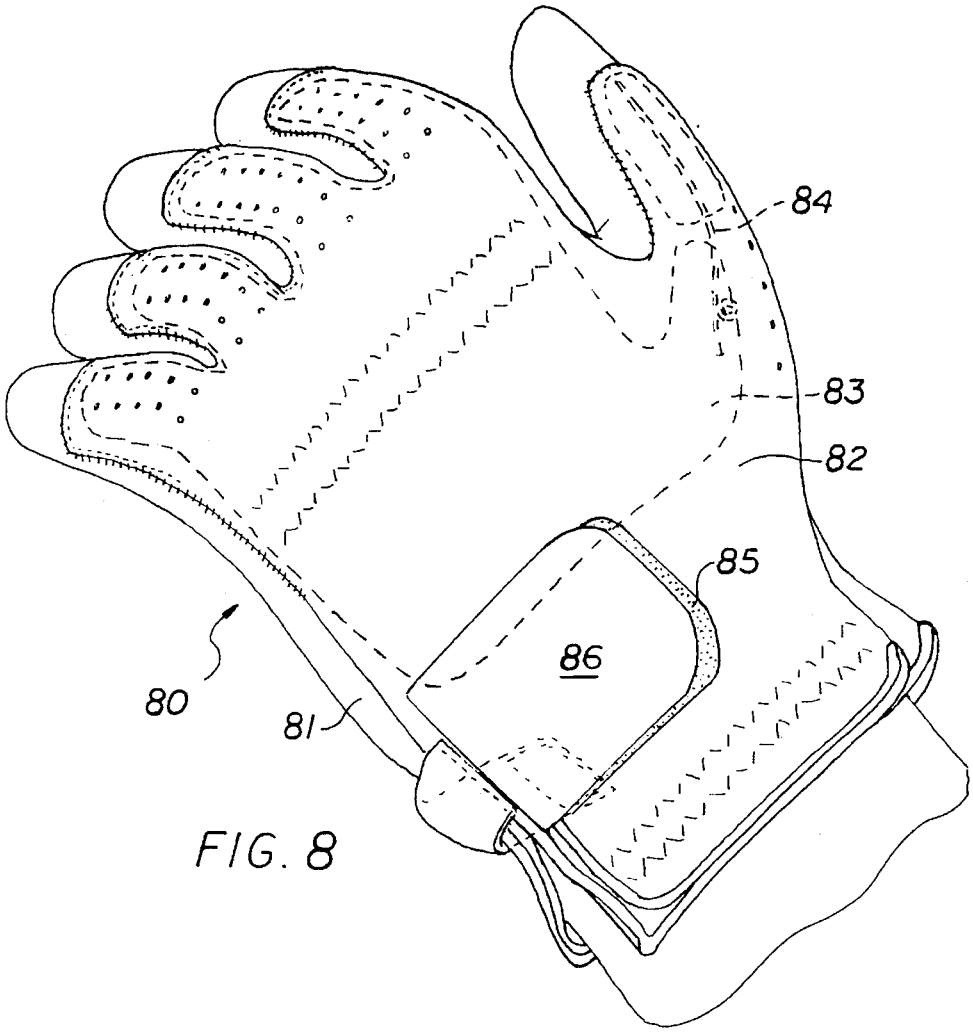
FIG. 8 is a perspective view of a remedial hand wear article of the invention intended for use by an individual who has suffered ulnar and median nerve damage.
Figure 9:
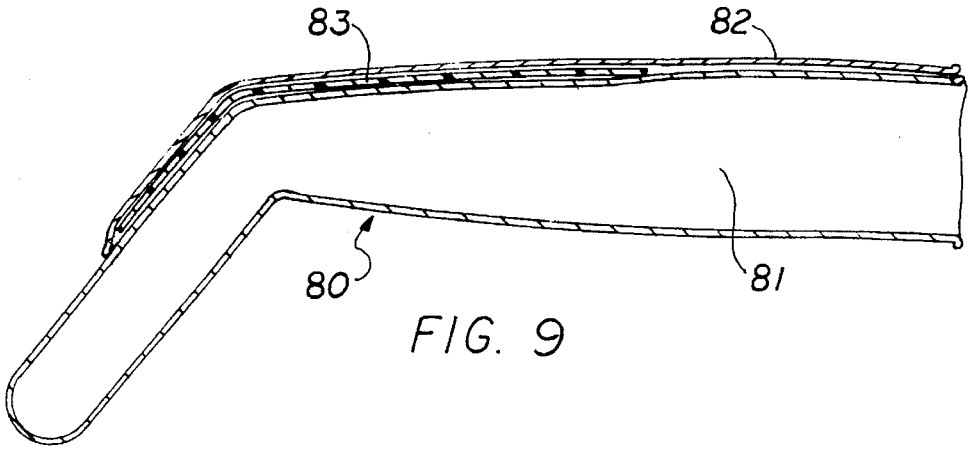
FIG. 9. is an elevational view in section of the remedial hand wear article of FIG. 8.

FIGS. 8 and 9 illustrate a remedial hand wear article intended for use by those individuals who have suffered both median and ulnar nerve damage. The article 80 basically combines the features found with the remedial hand wear articles 60 and 70 discussed above and with reference to FIGS. 5, 6 and 7.

The remedial hand wear article 80 comprises a glove 81, an enclosure 82, a substantially rigid member 83, and a spring wire 84. The glove is as described above. The enclosure 82 is shaped such that it covers substantially the full back hand side of the glove and all its fingers. The enclosure 82 is superimposed on the glove and permanently attached thereto. The substantially rigid member 83 is dimensioned and shaped to follow the contour of the back side of the user's hand, including the top side of the second through fifth fingers. The finger portions are slightly bent downwardly to hold the individual's second, third, fourth and fifth fingers in a generally straight, though natural manner. A spring wire 84 attached at one end to the rigid member 83 extends into the enclosure's elongated section overlying the first finger of the glove. Its nature and function are as described above with a corresponding component found in the remedial hand wear article 70. The retention member comprised of mating hook and loop fastener straps 85 and 86 is the same as described above with the other articles. It is positioned on the glove near its wrist end and is to hold the article firmly in position during use.

While the invention has been described in detail and with particular reference to the drawings, it should be understood various changes and modification of an obvious nature can be made. All such changes and modifications are considered within the scope of the appended claims.

I claim:

1. A remedial hand wear article for use by an individual afflicted with nerve damage, said hand wear article comprising:

(a) a glove having a back hand side, a palm side and five fingers extending therefrom for comfortably fitting onto a hand of the individual;

(b) an enclosure superimposed over the top side of the glove and permanently attached thereto, said enclosure having a planar section over the back hand side and an elongated section over each of the fingers of the glove and further wherein the planar section is contiguous with each elongated section;

(c) a substantially rigid member positioned within the planar section of the enclosure shaped and configured to hold the individual's wrist in a generally natural state; and (d) a substantially straight spring wire restraining member positioned within each elongated section of the enclosure and permanently attached to the substantially rigid member so as to be operably associated with a finger of the individual to hold the finger in a generally straightened state.

2. The remedial hand wear article of claim 1 wherein the substantially rigid member generally coincides with the shape of a top of the individual's hand, wrist and forearm.

3. The remedial hand wear article of claim 1 wherein the first, second, third, fourth and fifth fingers of the glove are open-ended such that the individual's fingertips are exposed so as to enhance touch sensations.

4. The remedial hand wear article of claim 1 further having a retention member positioned thereon near a wrist end of the glove for snugly holding the article to the individual during use.

5. The remedial hand wear article of claim 4 wherein the retention member is a set of mating hook and loop fastener straps.

6. A remedial hand wear article for use by an individual afflicted with nerve damage, said hand wear article comprising:

(a) a glove having a back hand side, a palm side and five fingers extending therefrom for comfortably fitting onto a hand of the individual;

(b) an enclosure superimposed over the top side of the glove and permanently attached thereto, said enclosure having a planar section over the back hand side of the glove and at least one elongated section over a finger of the glove;

(c) a substantially rigid member positioned within the planar section, said substantially rigid member contoured to follow the shape of a top of the individual's hand; and (d) at least one substantially straight spring wire restraining member positioned within an elongated section of the enclosure and permanently attached to the substantially rigid member so that each said spring wire restraining member is operably associated with a finger of the individual to hold the finger in a generally straightened state.

7. The remedial hand wear article of claim 6 wherein the substantially rigid member generally coincides with the shape of a top of the individual's hand, wrist and forearm.

8. The remedial hand wear article of claim 6 further having a retention member positioned thereon near a wrist end of the glove for snugly holding the article to the individual during use.

9. The remedial hand wear article of claim 8 wherein the retention member is a set of mating hook and loop fastener straps.

10. The remedial hand wear article of claim 6 wherein the substantially rigid member is generally flat to coincide with the top of the individual's hand.

11. The remedial hand wear article of claim 10 wherein the enclosure superimposed over the top side of the glove has five elongated sections including said at least one section with a spring wire restraining member positioned within each of the elongated sections.

12. The remedial hand wear article of claim 6 wherein the enclosure has five elongated sections superimposed over the glove's first, second, third, fourth and fifth fingers and further wherein the substantially rigid member generally coincides with the shape of the top of the individual's hand, second, third, fourth and fifth fingers when the fingers are slightly bent downwardly so as to prevent hyperextension of the individual's fingers and protect against any clawing deformity and wherein the spring wire restraining member is positioned within the elongated section superimposed over the first finger to hold the individual's first finger in a generally abducted state yet allow a movement thereof towards the individual's hand palm area.

13. The remedial hand wear article of claim 6 wherein the enclosure has three elongated sections including said at least one section superimposed over the glove's first, second and third fingers and further wherein (i) a spring wire restraining member is positioned within the elongated section superimposed over the first finger to hold the individual's first finger in a generally abducted state yet allow a movement thereof towards the individual's hand palm area and (ii) the substantially rigid member is contoured to follow the shape of the top of the individual's hand and further to extend into the elongated sections superimposed over the second and third fingers of the glove, said substantially rigid member shaped to hold the individual's second and third fingers in a generally straightened state.

* * * * *